US005373686A

United States Patent [19]

Lang et al.

[11] Patent Number: 5,373,686

[45] Date of Patent: Dec. 20, 1994

[54] APPARATUS FOR HOOPING A PACKAGE BY MEANS OF A BAND

[76] Inventors: Georg Lang, Marktheidenfelder Strasse 2, 8771 Triefenstein 1; Berthold Buehrle, Ringstrasse 25, 7902 Blaubeuren, both of Germany

[21] Appl. No.: 982,963

[22] Filed: Nov. 30, 1992

[30] Foreign Application Priority Data

Nov. 30, 1991 [DE] Germany ..... 4139571

[51] Int. Cl.[5] ..... B65B 13/04

[52] U.S. Cl. ..... 53/589; 100/26

[58] Field of Search ..... 100/26; 53/137.2, 138.6, 53/176, 139.4, 582, 585, 588, 589, 590

[56] References Cited

U.S. PATENT DOCUMENTS

| | | | |
|---|---|---|---|
| 3,252,408 | 5/1966 | Winkler | 100/26 |
| 3,566,780 | 3/1971 | Chisek | 100/26 |
| 4,292,785 | 10/1981 | Hammond | 53/589 X |
| 5,078,057 | 1/1992 | Pearson | 100/26 X |

FOREIGN PATENT DOCUMENTS

| | | |
|---|---|---|
| 0105557 | 4/1984 | European Pat. Off. . |
| 3303956 | 8/1984 | Germany . |
| 4100276 | 7/1991 | Germany . |
| 4024149 | 2/1992 | Germany . |

*Primary Examiner*—Linda B. Johnson

*Attorney, Agent, or Firm*—Spencer, Frank & Schneider

[57] ABSTRACT

An apparatus is described for hooping a package (8) by means of a band (19) in a hooping plane (5) extending in the conveying direction (4). The band guide channel (7) comprises two portions (10, 13) which lie on opposite sides of the hooping plane (5) and each of which is situated at so great a distance from the hooping plane (5) that they do not impede the conveying movement of the package (8). The portions (10, 13) are joined together, on opposite sides of the package (8), by other portions (9, 11 and 12) which pass through the hooping plane (5). In a position turned through 90°, in which the hooping plane (5) lies parallel to the conveying plane (1), the arrangement can also work as a horizontal hooping apparatus.

9 Claims, 2 Drawing Sheets

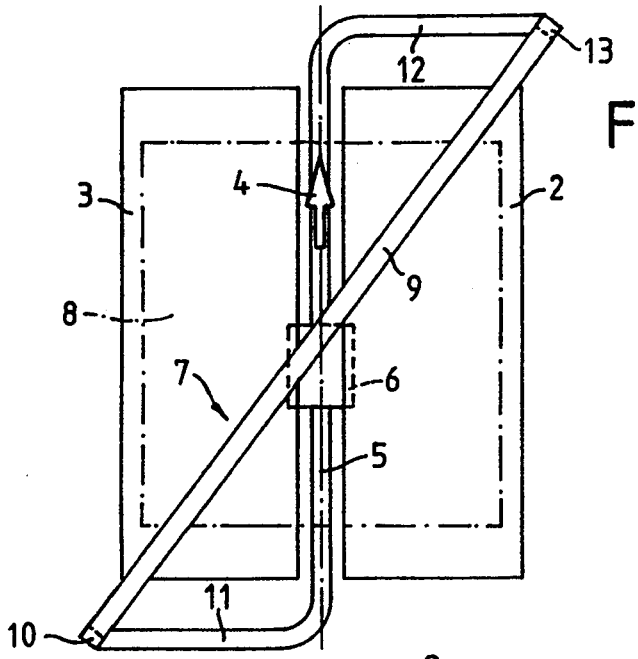
FIG. 1
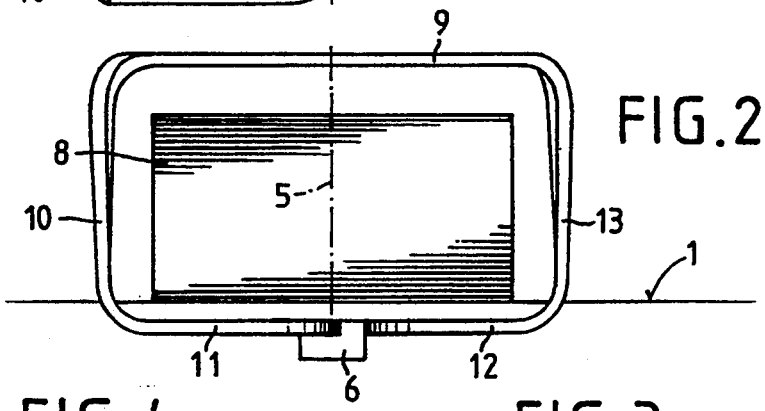
FIG. 2
FIG. 4
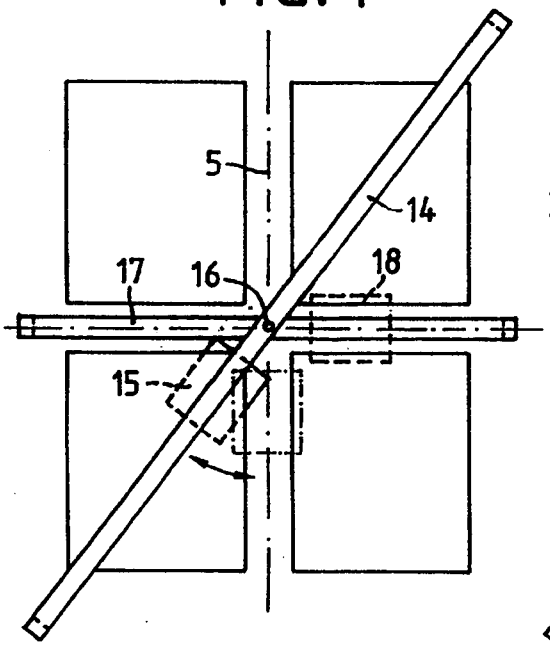
FIG. 3
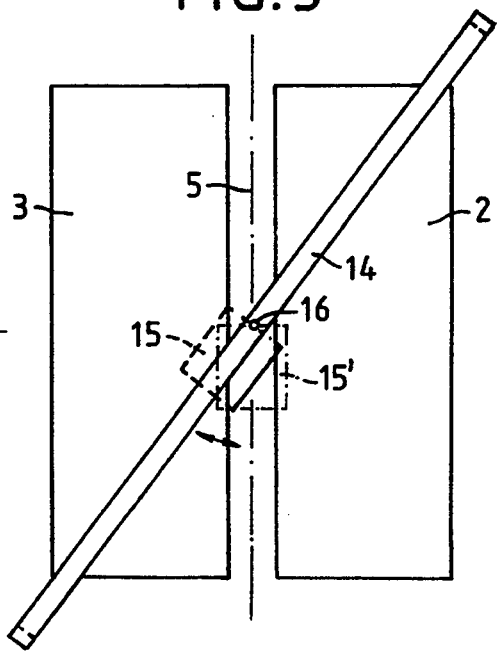

APPARATUS FOR HOOPING A PACKAGE BY MEANS OF A BAND

BACKGROUND OF THE INVENTION

The invention relates to an apparatus for hooping a package, for example a stack of newspapers, by means of a band. The apparatus has a horizontal conveyor defining a conveying plane and conveying the package rectilinearly into and beyond a hooping position. The apparatus further has a band guide channel forming a loop and having open or openable wall regions to allow the band loop formed therein toe be pulled out when it is applies to the package, and a binding head for inserting the band into the band guide channel and for tensioning, joining and severing the band. The hooping plane defined by the band applied to the package extends in the conveying direction.

An apparatus of this kind is known from German Offenlegungsschrift 33 03 956, FIG. 3. In this cross-hooping machine only the band guide channel for longitudinal hooping is of interest in connection with the present invention. It is constructed as a vertical frame extending in the conveying direction, in such a manner that the front and rear portions of the frame can be pushed up in order to bring the package into the hooping position and to convey it further.

Apart from the complicated construction required for band guide frame divided in this manner and comprising movable portions, the time needed for the hooping operation is considerable and consequently the efficiency of this machine is inadequate. The insertion of the band cannot start until the package has assured its hooping position and the band guide frame has been closed.

Another apparatus of the kind first defined above is known from German Offenlegungsschrift 41 00 276. In this known binding machine the band guide channel for longitudinal hooping of interest here is stationary and disposed on one side of the hooping plane, while the other side remains free. This requires a spatial shape of the band guide channel which does not coincide with the hooping plane. During the tensioning operation the inserted band loop is pulled laterally or obliquely out of the uneven band guide channel and slides over guide plates before being finally laid tightly against the package in the hooping plane.

This known arrangement of the band guide channel has the consequence that the loop length required on insertion, and consequently the excess length of band to be pulled back in the tensioning operation, is considerable. This has a negative effect on the cycle time and thus on the performance of the machine. Because of the necessary slight inclination of the guide plates, the speed at which the band is pulled during tensioning is limited. In addition, only particularly stiff grades of band can be used. Finally, difficulties arise in respect of the conveyor means that can be used.

SUMMARY OF THE INVENTION

It is an object of the invention to provide a hooping apparatus of the kind discussed above which is simpler and works at a higher speed and in which all customary types of hooping bands can be used.

This object and others to become apparent as the specification progresses, are accomplished by the invention, according to which, briefly stated, the apparatus for hooping a package includes a horizontal conveyor for advancing a package in a rectilinear advancing direction along a conveying path into and beyond a hooping station; and a band guide channel forming a loop and receiving the band therein. The band guide channel is situated in the hooping station and has open wall regions to allow the band to move out of the band guide channel in a direction transverse to a length dimension thereof. The apparatus further has a binding head for inserting the band into the band guide channel, for pulling the band from the band guide channel through the open wall regions thereof and for applying the band to the package, situated in the hooping station, in a hooping plane extending parallel to the advancing direction. The band guide channel is formed of first, second, third and fourth length portions. The first length portion is situated in its entirety on one side of the hooping plane and the second length portion is situated in its entirety on the other side of the hooping plane. The horizontal distance between the first and second length portions measured perpendicularly to the advancing direction is such as to allow passage of the package therebetween. The third length portion interconnects ends of the first and second length portions and traverses the hooping plane. The fourth length portion interconnects ends of the first and second length portions.

The band guide channel, which crosses the hooping plane, has a relatively simple spatial shape. The band loop is short and during tensioning has a natural tendency to swing by a tipping or turning movement into the plane predetermined by the binding head. This takes place unusually quickly and requires only small slide guides of simple shape, any at all.

One embodiment of the invention is distinguished in that the longitudinal center plane of the binding head is also the hooping plane and extends in the conveying direction, in that, starting from the binding head, the band guide channel merges via curves into the portions lying on opposite sides of the hooping plane, and in that on the opposite side to the binding head these portions are connected together by means of a portion passing obliquely through the hooping plane.

The band guide channel thus makes a double curve on that side of the package on which the binding head is disposed, the binding head constituting the turning region. The opposite portion is substantially rectilinear and together with the rectilinear portions parallel to the hooping plane forms a plane extending obliquely to the hooping plane. To enable the conveyor belt to leave the band guide channel during tensioning, the latter must be open in the direction of the package or be provided with closure means which can be moved away. During tensioning the band moves directly into the hooping plane without rubbing against the edges of the package.

A variant of the invention consists in that the band guide channel extends substantially in a plane which obliquely intersects the hooping plane in an intersection line extending at right angles to the conveying direction, and in that the binding head is mounted for pivoting about an axis extending in this intersection line and is driven in such a manner that when the band is inserted it assumes an angular position in which its longitudinal center plane coincides with the plane of the band guide channel and that on the tensioning of the band it pivots into the hooping plane.

The band guide channel accordingly forms a simple, plane rectangular frame having only on one portion two division points, namely before and after the binding head, while the division points can also, as required, be disposed at a distance from the binding head. In this case the binding head is extended in both directions by a length of band guide channel. The abovementioned intersection line or swivel axis need not pass centrally through the binding head, but may extend eccentrically or at a distance from it. Depending on the stiffness of the band, the band loop is driven solely by the pivoting movement of the binding head into the hooping plane.

The hooping apparatus described is normally constructed such that the hooping plane is at right angles to the conveying plane, as in all such apparatus- However, as a further development of the invention it is proposed to turn the entire apparatus about an axis pointing in the conveying direction, for example through 90°. In an apparatus of this kind the hooping plane extends parallel to the conveying plane. Packed objects, for example packets or bundles of upright bottles, delivered on a horizontal conveyor belt can thus be hooped horizontally.

In this case, as in all previously mentioned embodiments of the invention, it is only necessary to halt the conveyor belt, or to slow it down to a very low speed of travel, during the hooping operation. It is an advantage that it is never necessary to turn and lift the package in order to bring it into a hooping position.

It is obvious that if crossed hooping of the package with two band hoops is desired, the apparatus may be followed by a known transverse hooping machine. In the same way, however, it is also possible to extend the apparatus itself by adding a transversely extending band guide channel and another binding head, that is to say to form a cross-hooping machine. In this case of course, as is known, arrangements must be made to enable the band to pass out of the outer band guide channel transversely through the inner band guide channel.

BRIEF DESCRIPTION OF THE DRAWINGS

FIG. 1 is a top plan view of a longitudinal hooping apparatus having stationary binding head.

FIG. 2 is a view in the conveying direction of the apparatus shown in FIG. 1.

FIG. 3 is a top plan view of another longitudinal hooping apparatus having a pivotable binding head.

FIG. 4 is a top plan view of a cross-hooping apparatus.

DESCRIPTION OF THE PREFERRED EMBODIMENTS

Figure 5:
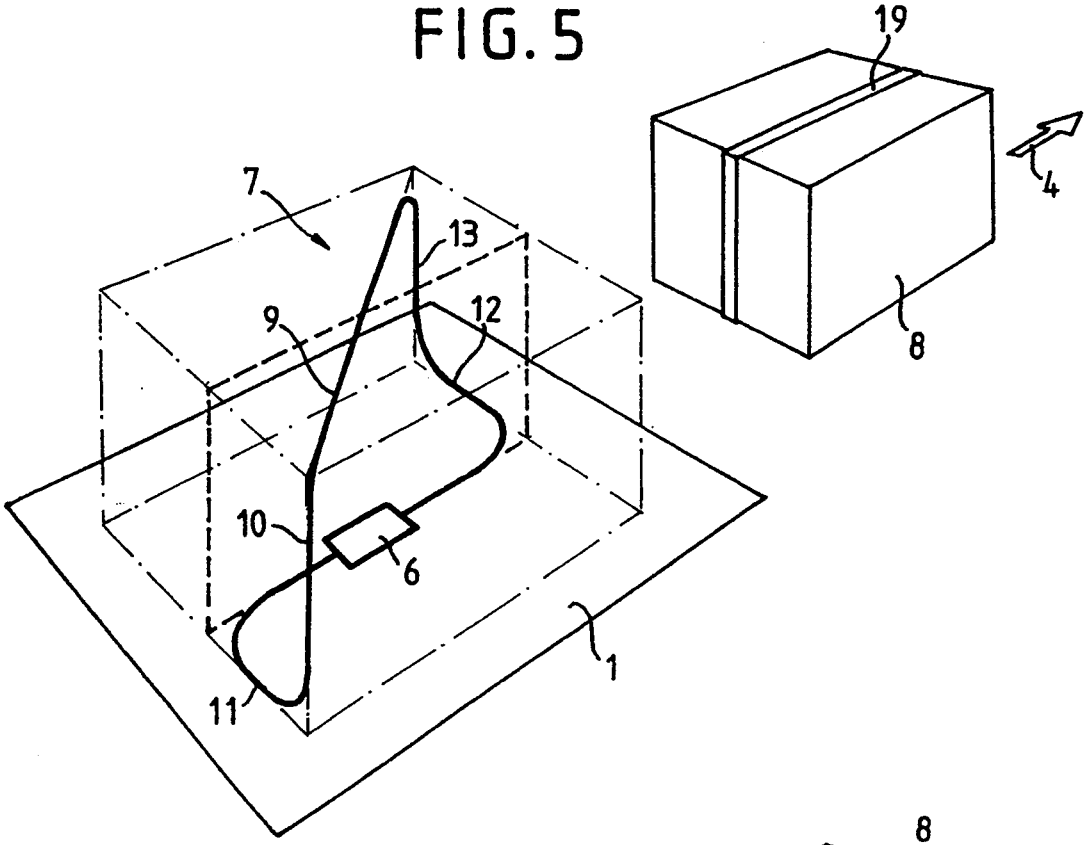
FIG. 5 is a schematic three-dimensional representation of a longitudinal hooping apparatus having a vertical hooping plane, similar to FIG. 1 but with oppositely directed curvature.

In the apparatus shown in FIGS. 1 and 2 the horizontal conveying plane 1 is represented schematically by two conveyors 2 and 3, the arrow 4 indicating the conveying direction. The imaginary hooping plane 5 extends in the conveying direction between the conveyors 2 and 3. It is at right angles to the conveying plane 1.

A binding head 6 of known the is situated in the central region under the conveying plane 1 and is able to insert a band, drawn off from a storage reel, into a band guide channel given the general reference 7, to pull back and thus tension the band loop, to weld the end of the band to the band at the beginning of the loop, and to sever the band loop. The binding head 6 and the band guide channel form a hooping station in the path of the conveyors 2, 3. The longitudinal center axis and longitudinal center plane of the binding head 6 indicate the rectilinear path on which the band is guided through the binding head 6. This longitudinal center plane lies in the hooping plane 5 and in the conveying direction 4. The package 8 is shown as a stack of newspapers in its hooping position (in dot-dash lines in FIG. 1).

The band guide channel 7 has a top horizontal, rectilinear portion 9 which passes obliquely through the hooping plane 5 above the package 8. On the left this portion is followed by a vertical portion 10, which in turn is followed by a horizontal portion 11 which lies below the conveying plane 1 and extends approximately transversely and then in a curve passes into the binding head 6 and thus into the hooping plane 5. The vertical portion 10 is accordingly twisted. In the curve the band guide channel is inclined transversely to the direction of the band. On the other side of the binding head 6, and likewise still below the conveying plane, the channel makes a curve towards the other side and then merges from a horizontal portion 12 into a vertical portion 13, which is then in turn followed by the top horizontal portion 9. The band guide channel 7 thus forms a closed loop in which the band is safely guided on its insertion and from which it cannot pass out accidentally.

The band guide channel 7 is provided, if necessary, with flaps or other movable closure members, which are so constructed that during tensioning the band can then pass out to the hooping plane 5 and be laid in said hooping plane around the package 8. Due to being guided in the binding head 6 the band tends, when tensioned, to pass out of the channel and lay itself around the package 8 in the hooping plane 5. Where the band guide channel extends under the conveying plane 1, the conveyor table is provided with a slot-like opening. The conveyors 2 and 3 shown in this example as conveyor belts also leave a slot free between them. It is to be regarded as a particular advantage of the invention that in the region of the apparatus so-called pushers can also be used instead of belt conveyor means. Where FIG. 1 is concerned such a pusher could be disposed in the right-hand bottom region, that is to say upstream of the vertical portion 13 in the conveying direction, and another in the left-hand top region, that is to say downstream of the vertical portion 10.

In the example of embodiment shown in FIG. 3 portions curved in plan view are absent, and the band guide channel 14 constitutes a planar frame. However, in this case the binding head 15 is pivotable about a vertical axis 16, which constitutes the line of intersection of the frame plane with the hooping plane 5. The pivoting drive is so designed that on insertion of the band the binding head 15 lies in the plane of the frame, that is to say obliquely to the conveying direction. As is also the case in the example shown in FIG. 1, the package can already pass into the hooping position during the insertion. However, as soon as the tensioning operation starts, the binding head pivots into the position 15', that is to say into the hooping plane 5, pulling the band with it. Movement patterns of the band similar to those in the example first described are thus obtained. Finally, the band lays itself, in the hooping plane 5, against the package 8, which is here not shown.

FIG. 4 shows a further development of the embodiment shown in FIG. 3, wherein an additional band guide channel 17 is disposed in the transverse direction and is provided with its own stationary binding head 18. The pivotable binding head 15 is disposed at a distance from the pivot axis 16, in contrast to FIG. 3, so that its pivoting movement is not impeded by the binding head 18. As is known in cross-hooping machines, the conveyors are divided into front and rear sections in order to be able to apply the transverse band. At the crossing points of the two band guide channels it is also necessary to make arrangements for the outer band to be able to pass through a gap in the inner band guide channel.

FIG. 5 shows, once again in a further simplified but three-dimensional representation, the apparatus shown in FIG. 1. However, instead of a right-hand curve a left-hand curve is shown, and conversely. The band guide channel with its individual portions is shown as a heavy black line, the same reference numerals being used. Where planes, such as for example the conveying plane 1 or the hooping plane 5, are shown, the rectangle drawn is not intended to delimit the extent of the plane, but only to represent the three-dimensional position of the plane in question. The cube shown in dot-dash lines, the sides of which extend in the conveying direction 4 and at right angles thereto, has no structural significance. In practice it does not exist, but serves solely to show the three-dimensional shape of the band guide channel. Strictly speaking, the binding head 6 and the portions 11 and 12 of the band guide channel are not situated in, but slightly below, the conveying plane 1.

The package 8, which is here a right parallelepipedic packet, is introduced from the left into the apparatus until it lies approximately centrally above the binding head 6. After the band 19 has been applied, the package 8 passes out of the apparatus as illustrated. The band 19 extends in the unlimited vertical hooping plane 5.

Figure 6:
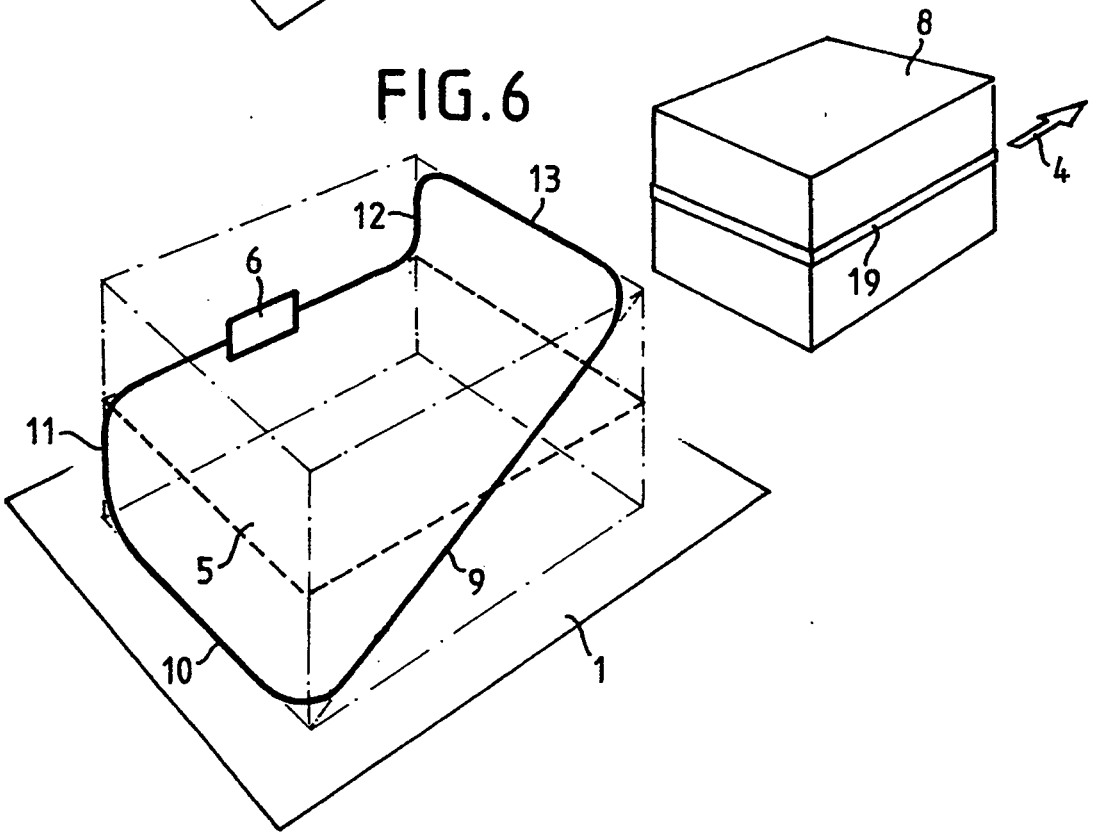
FIG. 6 is a schematic three-dimensional representation of a longitudinal hooping apparatus having a horizontal hooping plane.

With FIG. 5 as its starting point, FIG. 6 shows how by turning the apparatus through 90° a horizontal hooping apparatus can be formed. The hooping plane 5 here lies parallel to the conveying plane 1. The previously vertical portions 10 and 13 of the band guide channel now extend horizontally, the portion 10 being slightly below the conveying plane 1. The binding head 6 and the portions 11 and 12 are situated to the left of the package in a vertical plane. The portion 9 on the other side is inclined relative to the conveying plane 1. As can be seen, there are many advantageous possible ways of accommodating conveyor elements for the package 8 without obstruction.

It is claimed:

1. In an apparatus for hooping a package by means of a band; the apparatus including a horizontal conveyor for advancing a package in a rectilinear advancing direction along a conveying path into and beyond a hooping station; said horizontal conveyor defining a conveying plane;

a band guide channel forming a fixed loop and receiving the band therein; said band guide channel being situated in said hooping station and having open wall regions to allow the band to move out of the band guide channel in a direction transverse to a length dimension thereof; and a binding head for inserting the band into the band guide channel, for pulling the band from the band guide channel through the open wall regions thereof and for applying the band about the package situated in the hooping station; the band as applied to the package by said binding head from said fixed lop while the package is situated in the hooping station, defining a hooping plane extending parallel to the advancing direction; the hooping plane having opposite faces defining opposite first and second sides of the hooping plane;

the improvement wherein said band guide channel comprises (a) a first length portion situated in its entirety on said first side of said hooping plane and being at a distance therefrom; said first length portion having opposite first and second ends;

(b) a second length portion situated in its entirety on said second side of said hooping plane and being at a distance therefrom; said second length portion having opposite first and second ends; a distance between said first and second length portions measured perpendicularly to said advancing direction being such as to allow passage of the package therebetween;

(c) a third length portion connecting said first end of said first length portion with said first end of said second length portion; said third length portion traversing said hooping plane at an oblique angle and being situated above said conveying plane; and (d) a fourth length portion connecting said second end of said first length portion with said second end of said second length portion; said binding head being inserted in the fourth length portion; said first, second, third and fourth length portions constituting said loop of said band guide channel; said loop enclosing a loop area and said conveying plane passing through said loop area.

2. An apparatus as defined in claim 1, wherein said hooping plane is oriented perpendicularly to said conveying plane.

3. An apparatus as defined in claim 1, wherein said hooping plane is oriented parallel to said conveying plane.

4. An apparatus as defined in claim 1, further comprising an additional band guide channel disposed transversely to said advancing direction and an additional binding head cooperating with said additional band guide channel for forming a cross-hooping apparatus.

5. An apparatus as defined in claim 1, wherein said binding head has a longitudinal center plane coinciding with said hooping plane.

6. An apparatus as defined in claim 1, wherein said fourth length portion extends parallel to said third length portion; said loop being planar and lying in a loop plane intersecting said hooping plane along a line of intersection oriented perpendicularly to said advancing direction; further comprising means for pivotally mounting said binding head for pivotal motion into first and second positions about an axis coinciding with said line of intersection; in said first position a center plane of said binding head coinciding with said loop plane and in said second position said center plane of said binding head coinciding with said hooping plane; and means for pivoting said binding head from one of said first and second positions into the other of said first and second positions.

7. An apparatus as defined in claim 1, wherein said fourth length portion has first, second and third parts; said first part extending from said second end of said first length portion to said hooping plane, said second part extending in said hooping plane and said third part extending from said hooping plane to said second end of said second length portion.

8. An apparatus as defined in claim 7, wherein said first and third parts extend perpendicularly to said hooping plane.

9. An apparatus as defined in claim 1, wherein said third length portion of said band guide channel is situated above said conveying plane at a distance therefrom.

* * * * *